US008833407B2

(12) United States Patent
Clüsserath et al.

(10) Patent No.: US 8,833,407 B2
(45) Date of Patent: Sep. 16, 2014

(54) METHOD AND FILLING ELEMENT FOR FILLING CONTAINERS WITH A LIQUID FILLING MATERIAL

(75) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/521,072

(22) PCT Filed: Nov. 19, 2010

(86) PCT No.: PCT/EP2010/007037

§ 371 (c)(1),
(2), (4) Date: Jul. 9, 2012

(87) PCT Pub. No.: WO2011/116798

PCT Pub. Date: Sep. 29, 2011

(65) Prior Publication Data

US 2012/0298251 A1 Nov. 29, 2012

(30) Foreign Application Priority Data

Mar. 23, 2010 (DE) ..... 10 2010 012 577

(51) Int. Cl.
*B67C 3/02* (2006.01)
*B67C 3/28* (2006.01)
*B67C 3/26* (2006.01)

(52) U.S. Cl.
CPC ..... *B67C 3/2608* (2013.01); *B67C 3/286* (2013.01)
USPC ..... 141/128; 141/115; 141/311 A; 222/108

(58) Field of Classification Search
CPC ..... B67C 3/2608; B67C 3/286
USPC ..... 141/115, 128, 311 A, 392; 222/108
See application file for complete search history.

(56) References Cited

U.S. PATENT DOCUMENTS

| | | | | |
|---|---|---|---|---|
| 4,711,277 | A * | 12/1987 | Clish | 141/311 A |
| 5,954,086 | A * | 9/1999 | Ronchi | 137/244 |
| 6,409,055 | B1 * | 6/2002 | Officier | 222/559 |
| 7,308,917 | B2 | 12/2007 | Krulitsch | |
| 7,963,305 | B2 * | 6/2011 | Lupi et al. | 141/258 |

(Continued)

FOREIGN PATENT DOCUMENTS

| | | |
|---|---|---|
| DE | 102004013211 | 9/2005 |
| DE | 102006001178 | 7/2007 |

(Continued)

*Primary Examiner* — Timothy L Maust
(74) *Attorney, Agent, or Firm* — Occhiuti & Rohlicek LLP

(57) ABSTRACT

A method for open jet filling containers with a liquid filling material using a filling element having a filling material path in its interior. The filling material flows through the path formed by a liquid channel during filling. The filling element comprises a liquid valve arranged in the path for controlled dispensing of the filling material at a dispensing opening. Closing the valve forms a drip-prevention structure that stops dripping of the filling material at the dispensing opening. The method includes forming the drip-prevention structure by closing the filling element, thereby causing relative movement between first and second structures. The first structure is either a valve body or a function element that moves with the valve body when the filling element closes. The second structure comprises part of an enclosing inner contour of the path. The drip-prevention structure is formed only when the filling element is closed.

9 Claims, 12 Drawing Sheets

(56) References Cited

U.S. PATENT DOCUMENTS

| | | | | |
|---|---|---|---|---|
| 2006/0289078 | A1* | 12/2006 | Wingens et al. | 141/57 |
| 2009/0293985 | A1* | 12/2009 | Till et al. | 141/1 |
| 2012/0186695 | A1* | 7/2012 | Clusserath | 141/115 |

FOREIGN PATENT DOCUMENTS

| | | |
|---|---|---|
| DE | 102004003489 | 6/2012 |
| EP | 0850838 | 7/1998 |
| EP | 1000898 | 5/2000 |
| EP | 1698558 | 9/2009 |
| FR | 664686 | 9/1929 |
| FR | 2905121 | 2/2008 |
| JP | 6127596 | 5/1994 |
| WO | 2005/070767 | 8/2005 |
| WO | 2007/016957 | 2/2007 |
| WO | 2007/137727 | 12/2007 |

* cited by examiner

METHOD AND FILLING ELEMENT FOR FILLING CONTAINERS WITH A LIQUID FILLING MATERIAL

CROSS REFERENCE TO RELATED APPLICATION

This application is the national phase filing of international application no. PCT/EP2010/007037, filed Nov. 19, 2010, which claims priority to German application no. 10 2010 012 577.6, filed Mar. 23, 2012. The contents of the aforementioned applications are incorporated herein in their entirety.

FIELD OF DISCLOSURE

The invention relates to a method for open jet filling of container using a filling element, as well as an apparatus having a filling element for open jet filling of containers with a liquid filling material.

BACKGROUND

Particularly with methods and filling elements for the open jet filling of bottles or other containers, i.e. with methods and filling elements in which the respective container is arranged with its container opening beneath the filling element and at a distance from it, and the liquid filling material is dispensed into the container as an open filling jet during filling, it is customary and also necessary to prevent the liquid filling material from dripping from a dispensing opening after the liquid valve, and hence the filling element, has closed. For this purpose known filling elements exhibit so-called gas barriers as systems or structures that are permanently disposed in the product path or filling material path. Such gas barriers are essentially strainer-like inserts, each having a plurality of channel sections that are configured in the insert and open at both ends and whose cross-section is, in each case, selected so that filling material residues which, because of the surface tension of the liquid filling material and because of the ambient pressure, are present in these channel sections and possibly also in a part of the product path or filling material path above said channel sections, are held back. One of the disadvantages with this arrangement is that such gas barriers, which are permanently disposed in the product path and filling material path, are essentially unsuitable for the filling of products that contain solid or relatively solid constituents, e.g. for filling fruit juices containing pulps, fruit chunks, fruit fibres etc.

Consequently there has already been a suggestion (WO2007/137727 A2) to provide the respective gas barrier in the product path or filling material path so that it can be moved between an active state, in which the gas barrier is located in the product path or filling path, and an inactive state, in which the gas barrier is located outside the product path or filling material path. The fact that an additional control element is required for the gas barrier is a disadvantage.

SUMMARY

The object of the invention is to propose a method and a filling element for filling containers in which the structure that prevents the dripping is realized in a simplified way and has no limitations whatsoever as to the type of filling material, i.e. is particularly suitable for filling products having solid or relatively solid constituents.

It is a particularity of the invention that the structure for preventing the dripping is only established by relative motion of the valve body and/or of a function element moved with this valve body when the filling element or liquid valve closes, this relative motion occurring between, on the one hand, the valve body and/or the function element moved with it, and, on the other hand, the inner face or inner contour of the product path or filling material path configured in the filling element, for example in such a way that, in the process, a gas barrier that prevents dripping is established or that the filling element is closed in the immediate proximity of its dispensing opening. The filling element is part of a filling system, for example of a filling system of a rotary-type filling machine.

Further embodiments, advantages and possible applications of the invention arise out of the following description of embodiments and out of the figures. All of the described and/or pictorially represented attributes, whether alone or in any desired combination, are fundamentally the subject matter of the invention independently of their synopsis in the claims or their cross-references. The content of the claims is also made an integral part of the description.

BRIEF DESCRIPTION OF THE DRAWINGS

The invention is explained in detail below through the use of embodiment examples with reference to the figures. In the figures.

DETAILED DESCRIPTION

Figure 1:
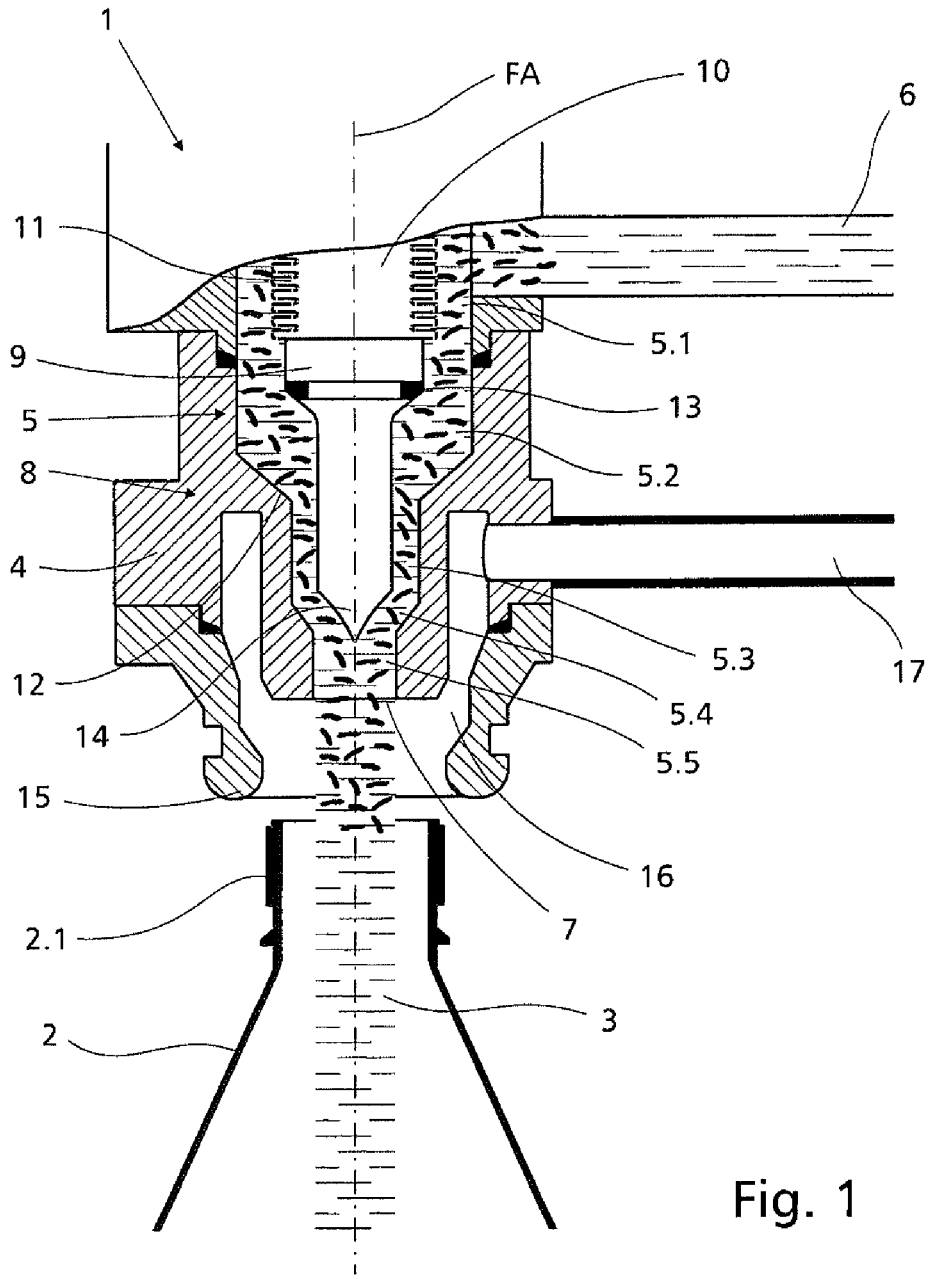
FIGS. 1 and 2 show, in simplified partial representation and in cross-section, an inventive filling element in two different operating states of which one is the opened and the other the closed operating state of the filling element.
Figure 2:
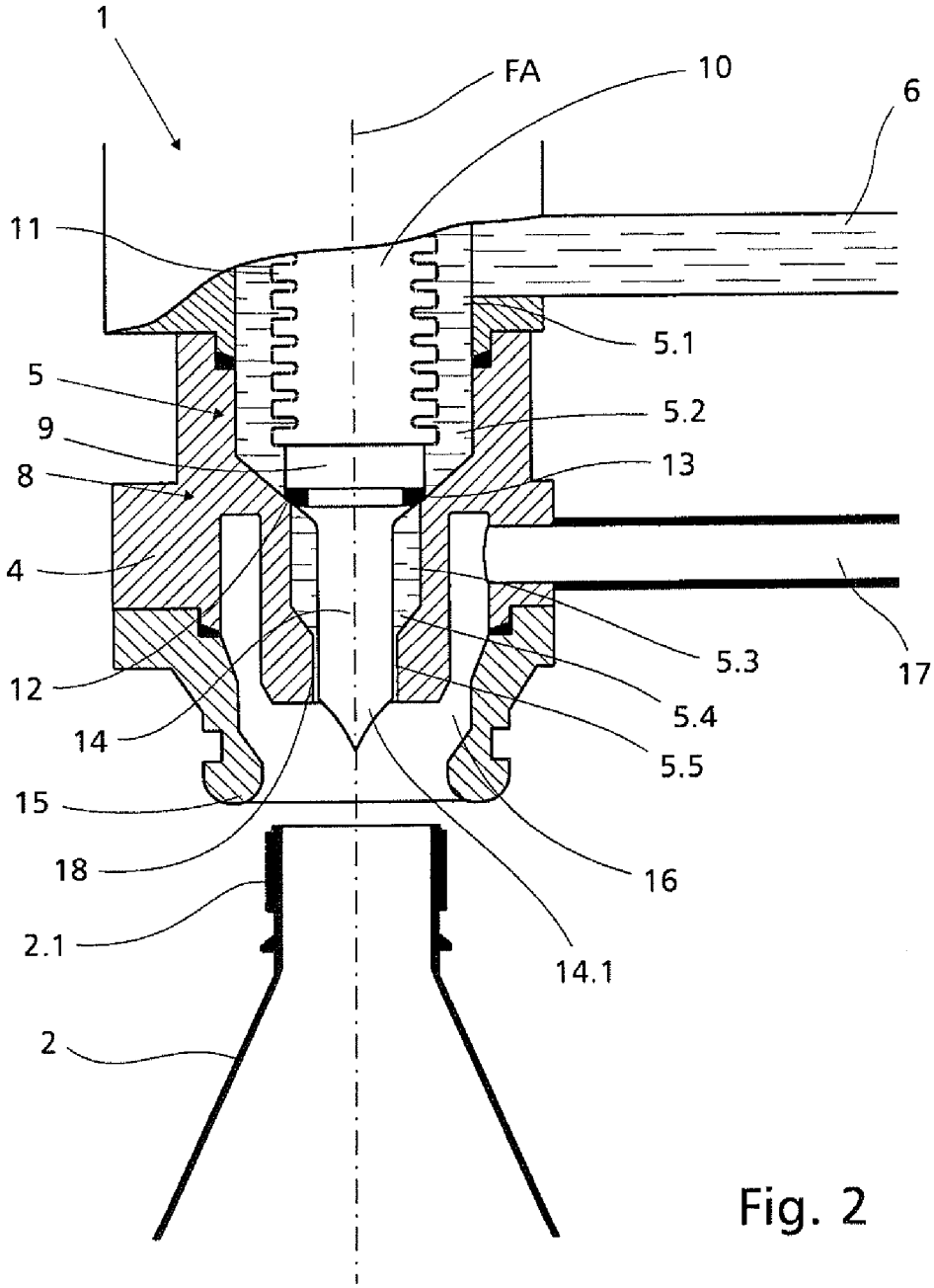

In FIGS. 1 and 2, 1 is a filling element of a filling system for filling containers in the form of bottles 2 with a liquid filling material, such as fruit juice, that in a liquid phase also contains solid or relatively solid constituents such as pulps, fruit fibres or fruit flesh. Filling element 1 is configured for an open jet filling of bottles 2, i.e. for a filling method in which the respective bottle 2 to be filled is disposed with its bottle opening 2.1 beneath and at a distance from filling element 1 so that, during filling, the liquid filling material is dispensed as a free filling jet 3 through bottle opening 2.1 into the interior of bottle 2. Filling element 1 is also part of a filling system, for example a rotary filling machine, in which, in the manner known to a person skilled in the art, a plurality of identical filling elements 1 are provided on a rotor (not shown) that can be driven to rotate about a vertical machine axis.

In detail, filling element 1 comprises housing 4 that, in the depicted embodiment, is composite and in which a liquid path or product path for the liquid filling material is configured in the form of a liquid channel 5. The latter is configured in the depicted embodiment to be rotationally symmetrical to a vertical filling element axis FA and is connected in its upper region to a product channel 6 for feeding the liquid filling material. On the underside of filling element 1, liquid channel 5 forms a dispensing opening 7 from which is dispensed, during filling, i.e. when liquid valve 1 (FIG. 1) is open, filling jet 3 that, to avoid contaminating the respective bottle 2, especially in the region of bottle opening 2.1, is a generally splash-free, i.e. clean, laminar-flow jet that also permits an at least low-foam filling of respective bottle 2 with the particular filling material.

In liquid channel 5 there is provided a liquid valve 8 that essentially comprises a valve body 9 at the lower end of a valve stem 10 with an outer concertina-like seal 11 and a circular-ring-shaped valve seat 12 that concentrically encloses filling element axis FA and that is formed by the inner face of liquid channel 5. Valve body 9 is equipped with a ring seal 13 with which it lies against valve seat 12 (FIG. 2) when filling element 1 is closed. Valve body 9 can be moved up and down on the filling element axis FA in a controlled manner with an actuating device (not shown) to open and close filling element 1 and/or liquid valve 8.

As FIGS. 1 and 2 also show, liquid channel 5 is composed of a plurality of channel sections 5.1-5.5 following one another in succession which, starting from the connection of product channel 6 going towards dispensing opening 7 and in the axial direction of filling element axis FA, are a channel section 5.1, which exhibits the largest diameter, into which product channel 6 opens and which, for example, exhibits a circular cylindrical inner face or inner contour, a subsequent tapering channel section 5.2, a subsequent channel section 5.3 having a much smaller diameter than the channel section 5.1 and, for example, again having a a circular cylindrical inner face, a subsequent channel section 5.4 that tapers in the form of a truncated cone, and a channel section 5.5 that forms the dispensing opening 7 and that, compared with channel section 5.3, exhibits a greatly reduced inside diameter having a circular cylindrical inner face or inner contour. All channel sections 5.1-5.5 lie on the same axis as the filling element axis FA. Valve seat 12 is formed by the inner face of channel section 5.2, to be precise, right at the transition between channel section 5.2 and channel section 5.3.

At its bottom end facing away from valve stem 10 and towards dispensing opening 7, valve body 9 is provided with a rod-like extension or plunger 14 that has a cylindrical peripheral surface, that is configured with its lower end 14.1 tapering to a point and that is arranged with its longitudinal extension on the same axis as filling element axis FA.

Plunger 14 is configured, t least at its bottom end 14.1 that is tapered to a point or cone-shaped, with a liquid-repellent surface or coating (lotus effect). Plunger 14 also exhibits a cylindrical outside diameter that is slightly smaller than the inside diameter of channel section 5.5. The axial length of plunger 14, which is disposed on the same axis as filling element axis FA, and hence on the axis of valve stem 10, is somewhat greater than the axial distance of valve seat 12 from dispensing opening 7 in the direction of filling element axis FA. Plunger 14, which for example is manufactured as a single piece with valve body 9, immediately adjoins that section of valve body 9 that exhibits seal 13.

In the depicted embodiment, at the bottom of its housing 4, filling element 1 also exhibits a bell-shaped body 15 that encloses dispensing opening 7 or a part of housing 4 that includes the opening, and in particular in such a way that the dispensing opening 7 is located in the interior space 16 formed by the bell-shaped body 15. The bell-shaped body 15 is open at the bottom during filling and is sealed off with a washing cap (not shown) for the purpose of cleaning and/or disinfecting filling element 1, e.g. for CIP cleaning and/or CIP disinfection. A tube 17, for supplying or removing the liquid cleaning and/or disinfection medium, leads into interior space 16.

For the open jet filling of respective bottle 2 positioned under filling element 1, liquid valve 8 is opened by lifting valve body 9 on filling element axis FA in a first open stroke. With filling element 1 fully opened, valve body 9 is now in the part of liquid channel 5 that is formed by channel section 5.1 as shown in FIG. 1. Plunger 14 is completely received into the part of liquid channel 5 formed by channel sections 5.1-5.3 such that an annular liquid or product path of sufficiently large flow cross-section is formed around plunger 14 allowing the liquid filling material, including filling material with solid or relatively solid constituents, to flow smoothly through liquid channel 5 without interruption.

Once the required quantity of filling material has been introduced into bottle 2 positioned under filling element 1, liquid valve 8, and with it filling element 1 are closed in a first close stroke. In this operating state, which is depicted in FIG. 2, and in which seal 13 of valve body 9 is in sealed contact against valve seat 12, plunger 14 protrudes from dispensing opening 7 by its lower end 14.1 and not only extends over part of its length through channel sections 5.3 and 5.4 but is also received over part of its length in channel section 5.5 in such a way that an annular gap 18 is formed between the outer face of plunger 14 and the inner face or inner contour of channel section 5.5. This annular gap 18 is so small in width that when liquid valve 1 is closed it acts as a structure in the form of a gas barrier, or annular gap gas barrier, that prevents dripping of the filling material and that, in particular, effectively prevents the filling material left in channel sections 5.3 and 5.4 from dripping from dispensing opening 7. The gap width of annular gap 18 is e.g. many times less than the maximum width exhibited by the annular gap in channel section 5.3 when liquid valve 8 is closed, and is e.g. no more than 20% of that width.

When liquid valve 8 closes, plunger 14, which in particular enters channel section 5.5, displaces filling material out of channel section 5.5 and this could result in a temporary increase in the quantity of liquid or volumetric flow rate in filling jet 3 with an attendant splashing of the filling material onto external surfaces of bottle 2 including, in particular onto the region of bottle opening 2.1. In order to avoid this, a slow or indexed movement of valve body 9 into the closed position is, for example, effected by an appropriate triggering and/or configuring of the actuating device interacting with valve stem 10. A gentle, splash-free displacement of the liquid filling material from channel sections 5.4 and 5.5 when liquid valve 8 closes or during the close stroke can also be achieved by an appropriate configuration of the contour of the inner face of channel section 5.5 and/or of the outer face of plunger 14, at least over that part of its length that is received in channel section 5.5.

Figure 3:
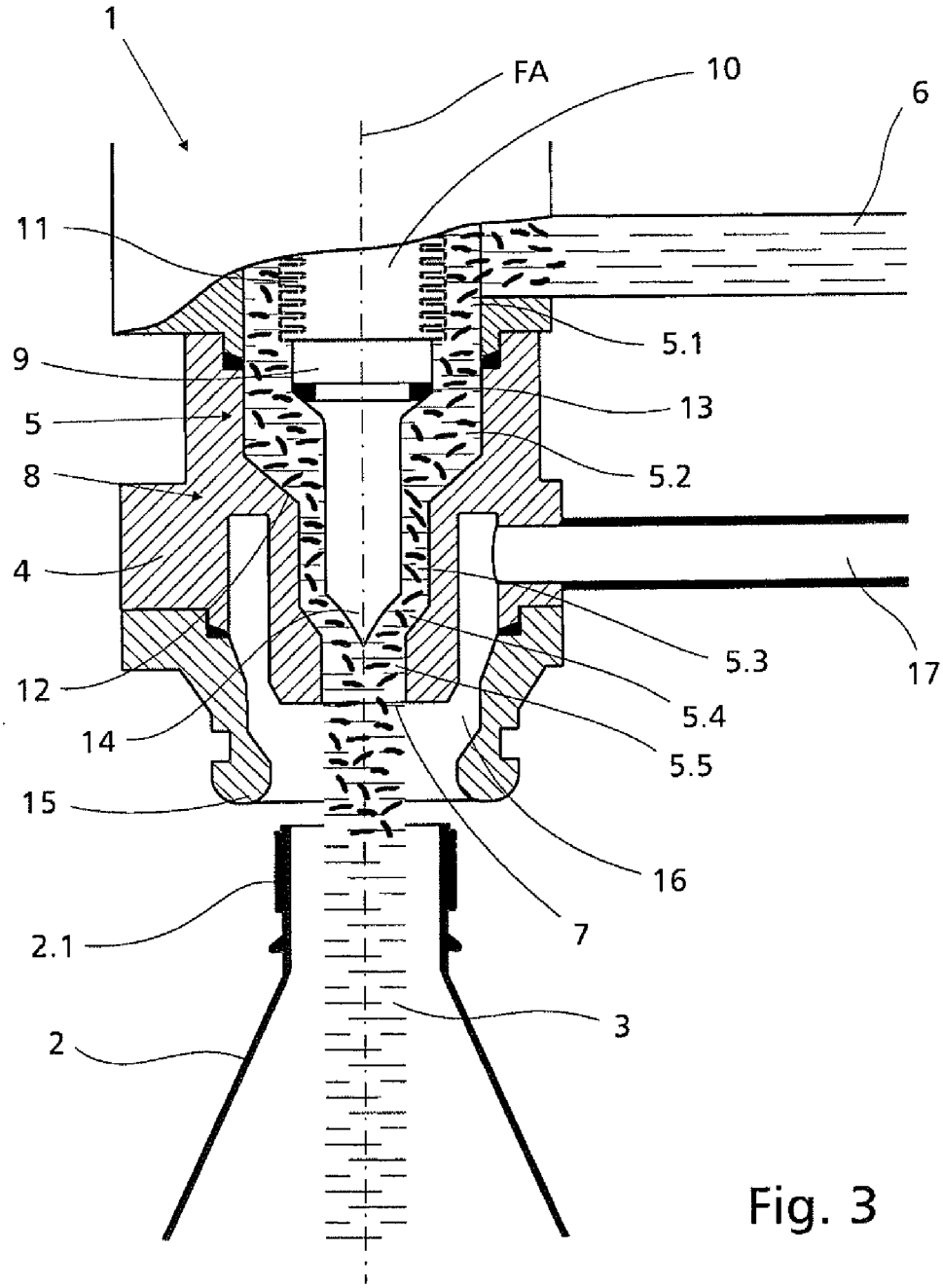
FIGS. 3-6 show, in partial representation and in cross-section, the filling element of FIGS. 1 and 2 in four different operating states, of which two are again the opened and closed operating state of the filling element.

FIGS. 3-6 again show filling element 1 in the fully open operating state (FIG. 3) and in the fully closed operating state (FIG. 6) as well as in two other operating states that filling element 1 assumes when closing.

Figure 4:
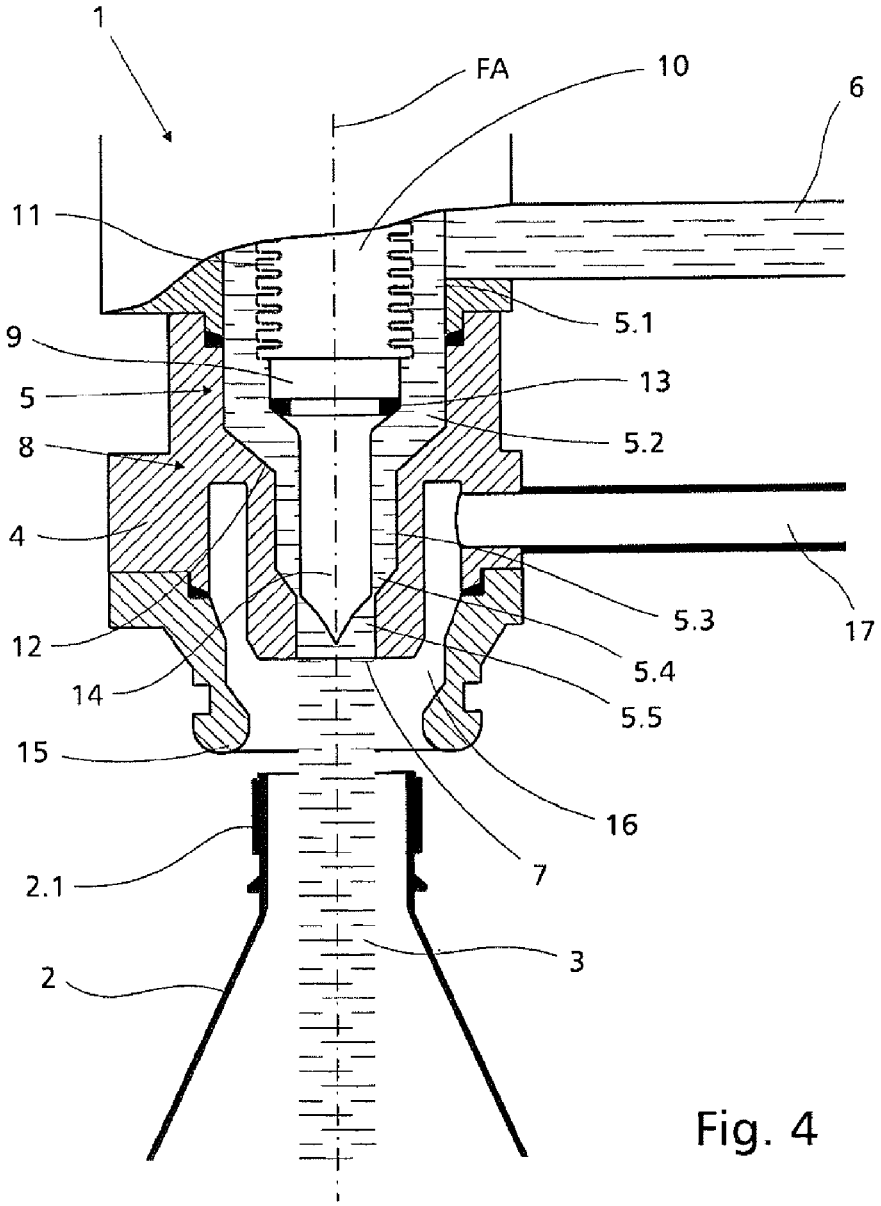
Figure 5:
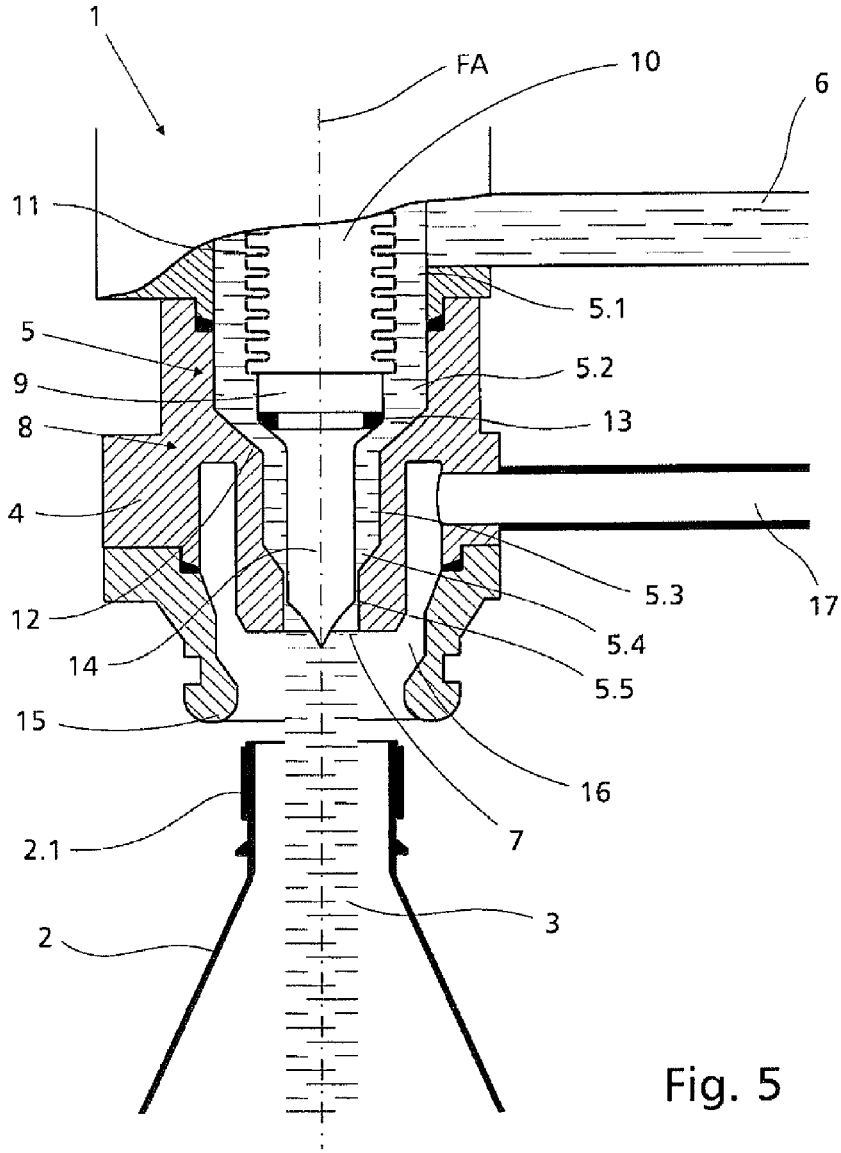
Figure 6:
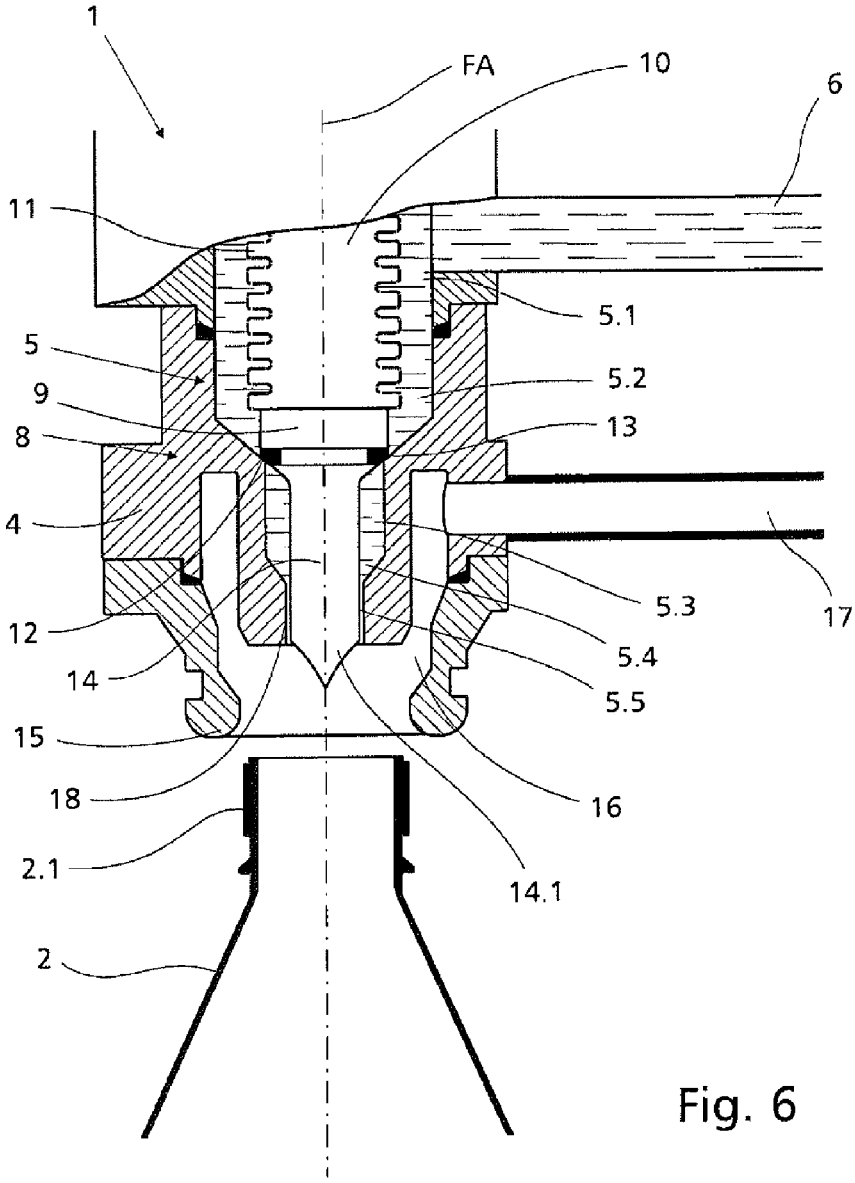

As depicted in FIG. 4, when liquid valve 8 closes, valve stem 10 moves valve body 9 initially from its open position downwards in a first close stroke into an intermediate position in which, although valve body 9 or its seal 13 are still a considerable distance away from valve seat 12, plunger 14 is moved just far enough into channel section 5.5 for a short annular gap to be formed between the cylindrical inner face of channel section 5.5 and the cylindrical outer face of plunger 14 and right at the transition between channel sections 5.4 and 5.5. In this state, filling element 1 is already closed so far that the liquid filling material is now dispensed at dispensing opening 7 with at best a reduced quantity. The final closing of liquid valve 8 then takes place in a subsequent second close stroke as shown in FIGS. 5 and 6. The second close stroke is executed preferably with a stroke speed that is considerably slower than the first close stroke so that filling material residues are pushed out, including particularly from channel section 5.5, by plunger 14 at dispensing opening 7 very gently and in particular without splashing.

When filling element 1 is in the closed state (FIG. 6), plunger 14 again forms, with the inner face of channel section 5.5, an annular gap 18 that functions as a gas barrier, i.e. an annular gap gas barrier that extends over the complete axial length of this channel section and with which the residues of filling material, especially those remaining in channel sections 5.3 and 5.4, are retained.

As described, when filling element 1 closes, the movement of valve body 9 with plunger 14 preferably does not happen in a single stroke but is indexed, i.e. in separate partial steps or movements. It is also, in particular, possible for the individual partial movements or steps to take place at different speeds and/or for movement to stop altogether between at least two partial movements. Instead of or as well as this, it is again possible when closing the filling element to achieve a uniform and specifically splash-free and/or drip-free displacement of the filling material, particularly from channel sections 5.4 and 5.5, through an appropriate geometrical design of the inner contour of liquid channel 5 and/or outer contour of valve body 9 and/or of plunger 10, taking for example the form that, even with a constant closing movement of valve body 9, the resulting displacement of the liquid filling material in particular from channel sections 5.4 and 5.5 generates no excessive and/or abrupt increase in the volumetric flow rate in filling jet 3 to cause splashing of filling material 3, and that rather, even in the case of a continuous closing movement, a state is achieved as would be attainable by a slow and/or step-by-step or interrupted movement of valve body 9 into the closed position.

Figure 7:
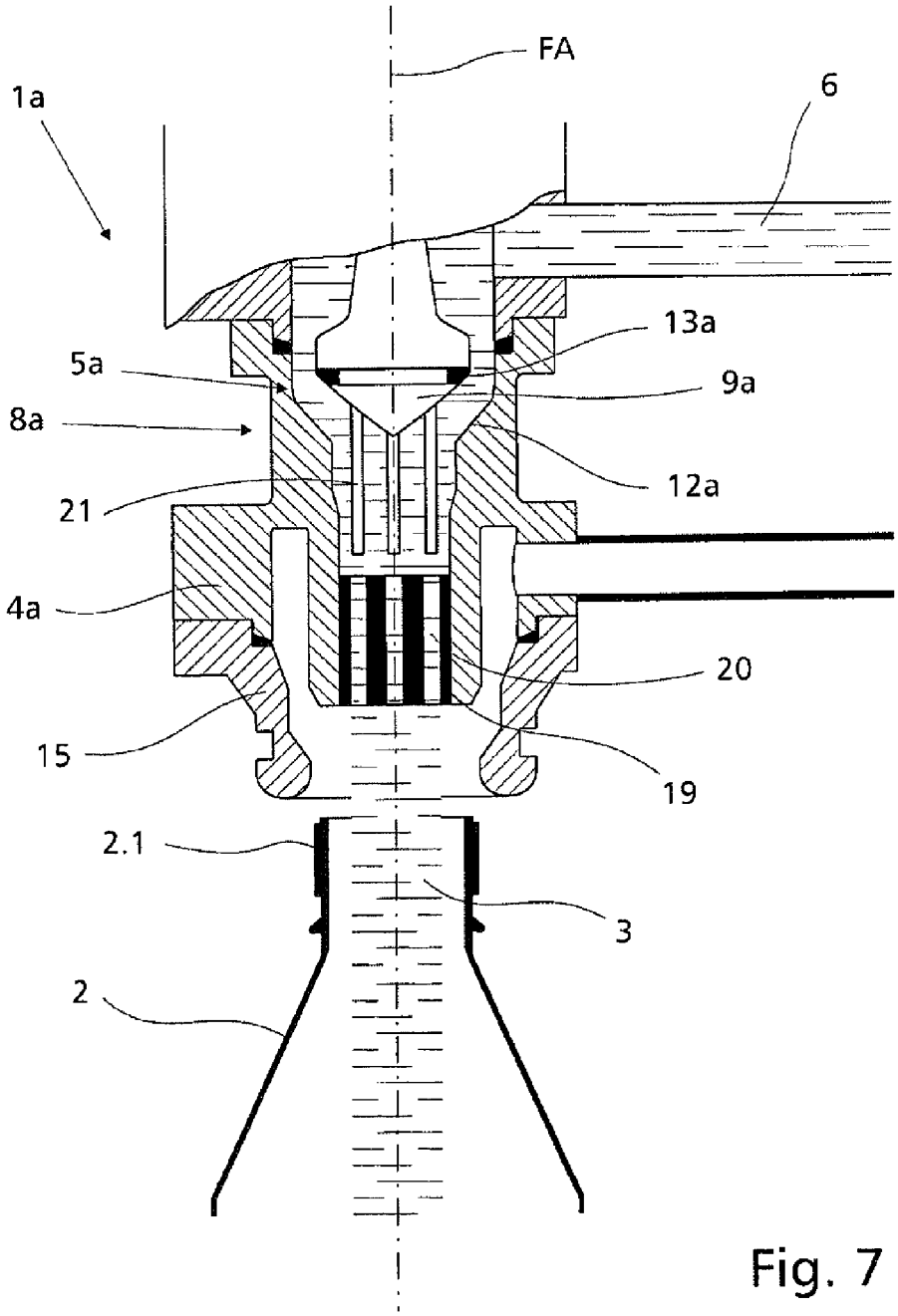
FIGS. 7 and 8 show, in partial representation and in cross-section, a further inventive filling element in the opened and closed operating state.
Figure 8:
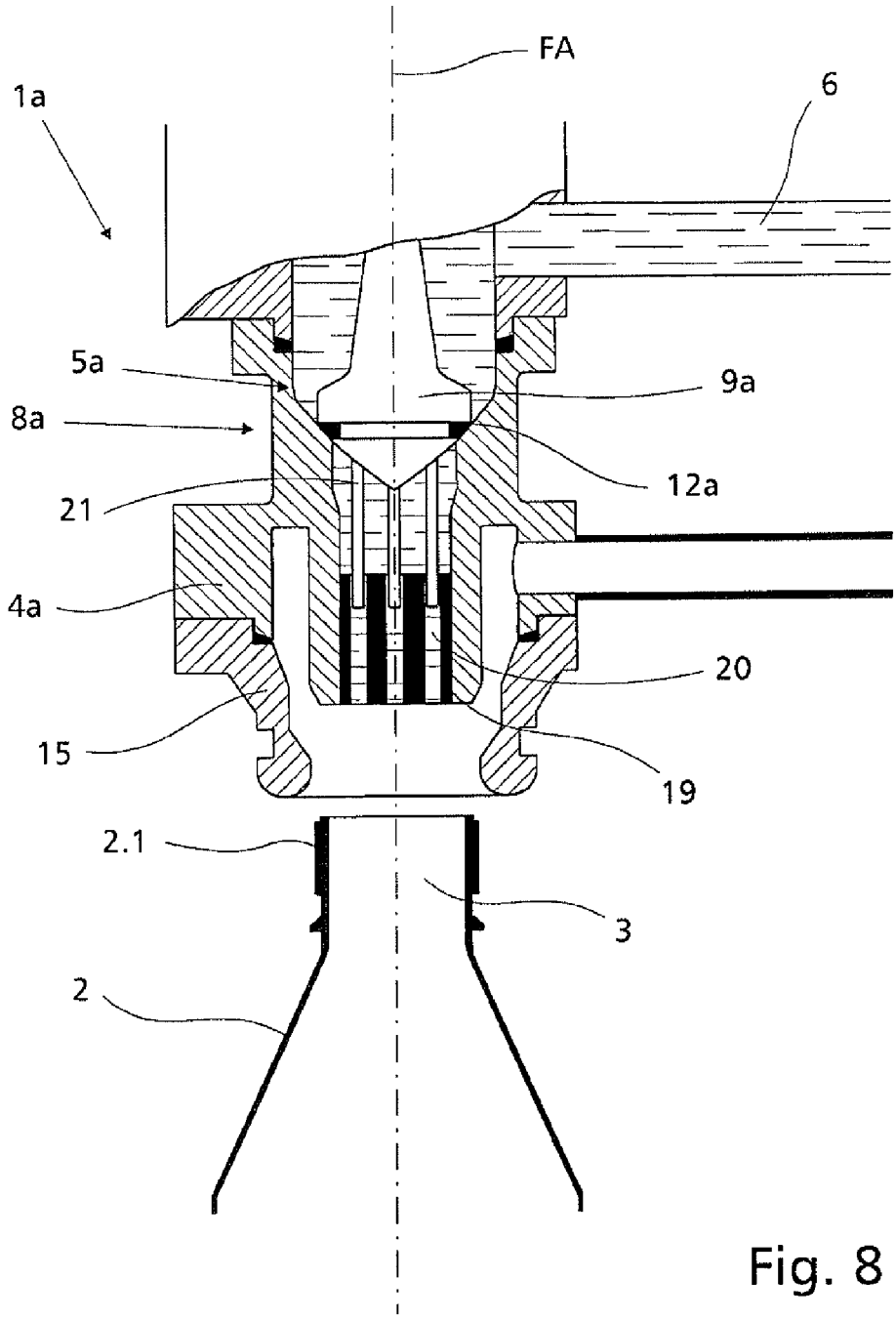

FIGS. 7 and 8 show, as a further embodiment, a filling element 1*a* that, in filling element housing 4*a*, has a liquid channel 5*a* with liquid valve 8*a* and that, in essence, differs from filling element 1 of FIGS. 1-6 in that in the case of filling element 1*a*, instead of a channel section 5.5 that forms a single dispensing opening, there is inserted into liquid channel 5*a* at the bottom of the filling element an insert 19 that has a plurality of channels or channel sections 20, each arranged with its axes parallel to the other channels or channel sections and to filling element axis FA and each of which is open at its upper and lower ends. With the lower open ends of channel sections 20, insert 19 thus forms a plurality of dispensing openings from which, during open jet filling, filling jet 3 flows to bottle 2 positioned under filling element 1*a* as a jet that is as uniform and as laminar as possible.

Liquid valve 8*a* consists in turn of valve body 9*a* which can be controlled to move in the direction of filling element axis FA and which, when filling element 1*a* or liquid valve 8*a* (FIG. 8) is closed, lies against valve seat 12*a* formed on the inner face of liquid channel 5*a*. A number of rod-like plungers 21 are held by their top ends on the underside of valve body 9*a*. The number and arrangement of plungers 21 which are oriented with their axes parallel to one another and to filling element axis FA is the same as the number and arrangement of channel sections 20 in insert 19. The bottom ends of plungers 21 all lie in a common plane square to filling element axis FA. The axial length of plungers 21 is also selected such that when liquid valve 8*a* is open, i.e. when valve body 9*a* is raised to the maximum stroke position, the bottom ends of the plungers are at a considerable distance away from the insert 19 and from the top ends of channel sections 20. An unhindered flow of filling material through liquid channel 5*a* and through channel sections 20 is therefore possible when liquid valve 8*a* is open. When filling element 1*a* is closed, as shown in FIG. 8, plungers 21 each extend over part of their length into an associated channel section 20. Over this part of their length at least, plungers 21 possess a preferably circular-cylindrical outside diameter that is somewhat smaller than the preferably circular-cylindrical inside diameter of the channel sections 20 at that point, so that when filling element 1*a* is closed, an annular gap with a cross-section that is considerably smaller than the cross-section of channel sections 20, for example with a cross-section less than 20% of the cross-section of the respective channel section 20, is formed in each channel section 20 between its inner face and the outer face of the associated plunger 21.

The cross-section of channel sections 20 is preferably selected so that trouble-free filling of even a filling material with solid or relatively solid constituents is possible, in which case insert 19 as such is now not effective or only partly effective as a structure or gas barrier that prevents the filling material from dripping after liquid valve 8*a* closes. Insert 19 becomes fully effective as the drip-preventing structure or gas barrier through plungers 21, which extend into channel sections 20 when liquid valve 8*a* is closed.

It was assumed above that insert 19, with its channel sections 20, does not of itself form a gas barrier. However insert 19, with its channel sections 20, can also be configured so that it does, of itself, provide a gas barrier, in particular when filling element 1*a* is used for filling liquid products having no solid or relatively solid constituents. In any event, however, the filling operation is ended or is in effect ended when liquid valve 8*a* closes by the fact that plungers 21 each plunge down into their respective channel section 20. A further advantage of plungers 21 is that through this plunging down into channel sections 20, any remaining traces of solid or relatively solid filling material constituents, such aspulp, fruit chunks, fruit fibres etc., are cut off and/or pushed down into channel sections 20 by plungers 21, thereby reliably avoiding the formation of clumps etc.

Figure 9:
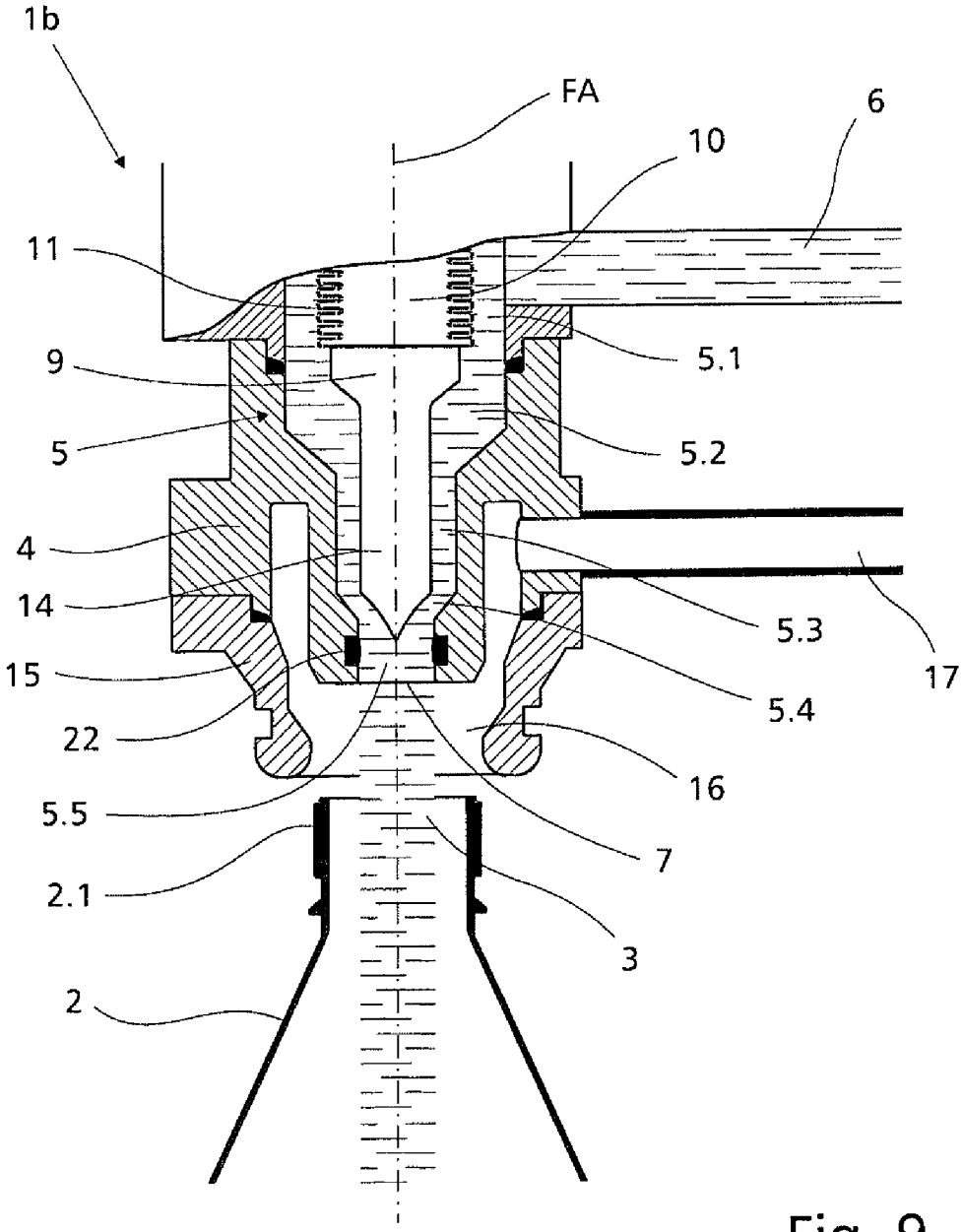
FIGS. 9 and 10 show, in partial representation and in cross-section, a further inventive filling element in the opened and closed operating state.
Figure 10:
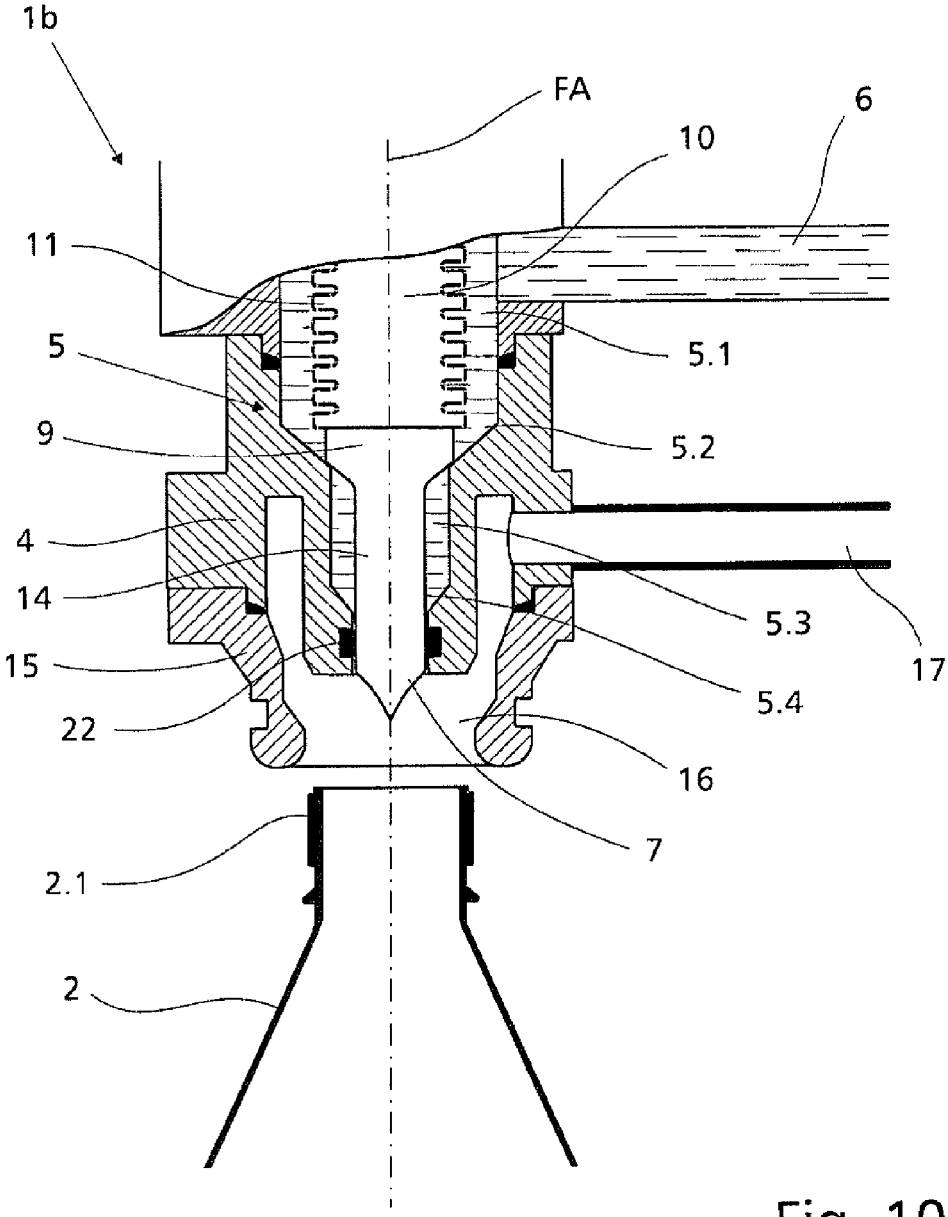

FIGS. 9 and 10 show as a further embodiment a filling element 1*b* that is again intended for the open jet filling of bottles 2 or other containers with the liquid filling material and that has, in its basic structure, great similarities to filling element h of FIGS. 1-6, so that in FIGS. 9 and 10 the components of filling element 1*b* that are identical with components of filling element 1 are indicated by the same reference numbers that are used in FIGS. 1-6.

Consequently filling element 1*b* in essence only differs from filling element 1 in that valve body 9 does not exhibit seal 13, and also in that when filling element 1*b* is in the closed state, liquid channel 5 is sealed tight by a ring seal 22 that concentrically encloses the filling element axis FA, that is provided on the inner face of channel section 5.5 or in an annular ring slot there, and that, when liquid valve 1*b* is closed, also encloses plunger 14 and lies tight up against this plunger 14.

A dripping of liquid filling material when filling element 1*b* is closed is prevented by ring seal 22 being right at dispensing opening 7 and by the annular gap formed between the inner face of channel section 5.5 and outer face of plunger 14 between ring seal 22 and dispensing opening 7 exhibiting a much reduced gap width. The structure that prevents dripping when filling element 1*b* is closed is therefore formed by ring seal 22 provided right at dispensing opening 7 and interacting with plunger 14.

Figure 11:
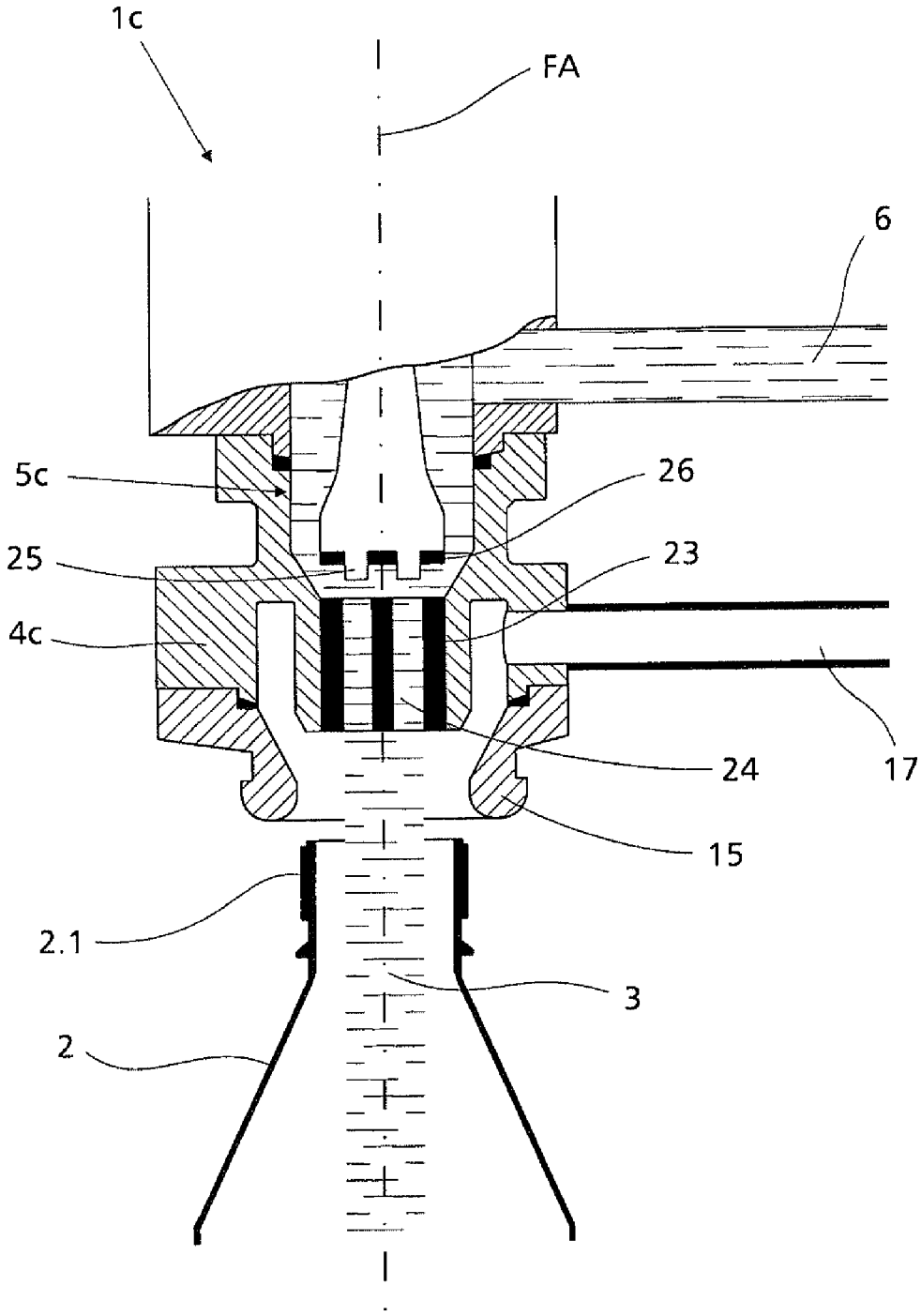
FIGS. 11 and 12 show, in partial representation and in cross-section, a further inventive filling element in the opened and closed operating state.
Figure 12:
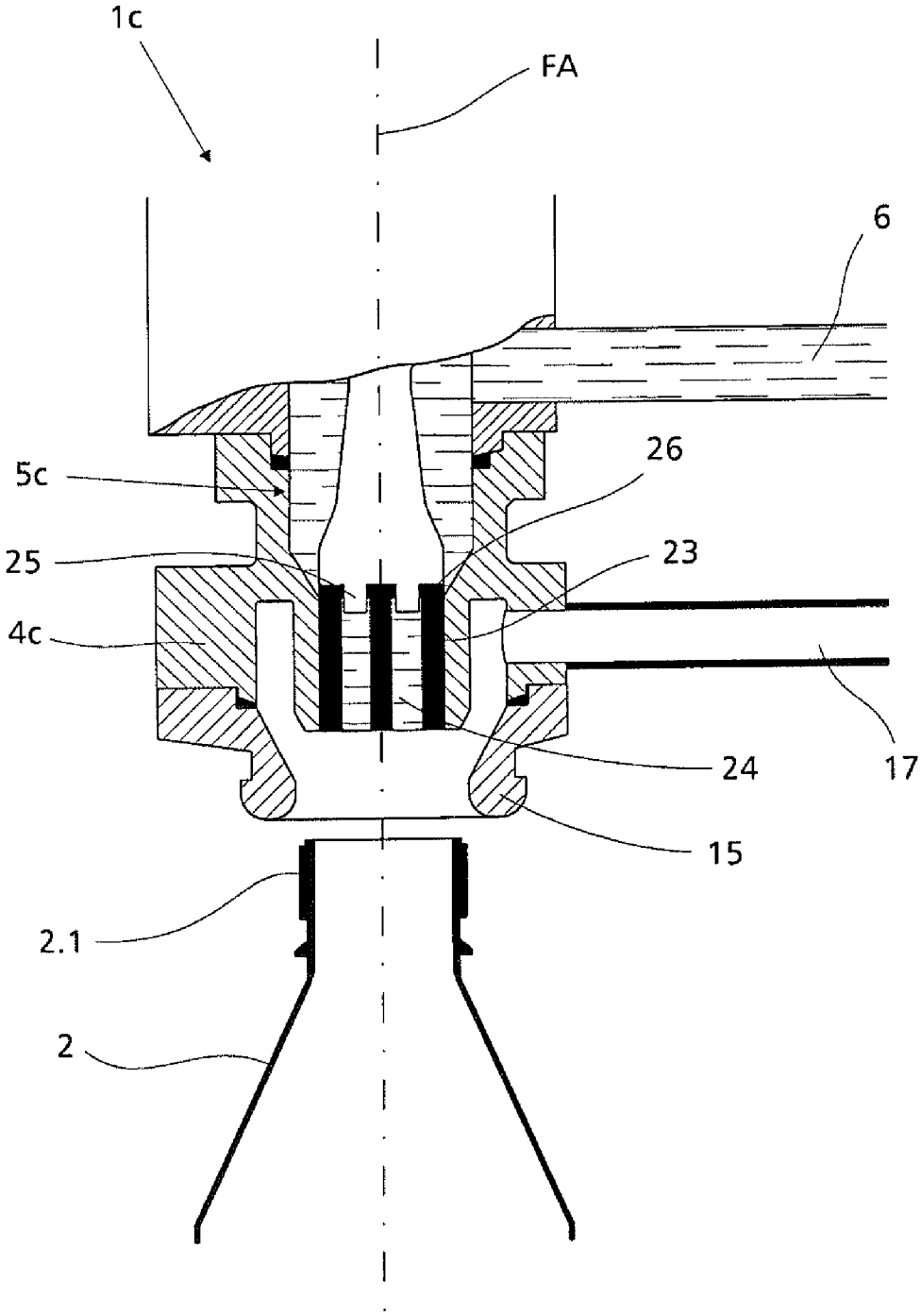

FIGS. 11 and 12 show, as a further embodiment, a filling element 1*c* that displays certain similarities with filling element 1*a* in FIGS. 7 and 8 and is again intended for the open jet filling of bottles 2 or of other containers with the liquid filling material.

Filling element 1*c* consists in essence of filling element housing 4*c* in which is configured liquid channel 5*c* connected to product channel 6 in which liquid valve 8*c* is located. An insert 23, which is executed with a plurality of continuous channel sections 24 open at both ends, is inserted in the bottom of liquid channel 5*c*. Channel sections 24 are oriented with their axes parallel to one another and to filling element axis FA, and with their lower open ends form dispensing openings from which, during filling, the liquid filling material flows as an open filling jet 3 into the interior of respective bottles 2 positioned under filling element 1*c*. In this embodiment, liquid valve 8*c* is formed by a plunger 9*c* or a valve body 19 that can be moved up and down through a given stroke in a controlled manner along vertical filling element axis FA to open and close liquid valve 8*c*. On the underside, which in the depicted embodiment is flat or essentially flat and disposed in a plane square to filling element axis FA, valve body 9*c* is provided with peg-like projections or plungers 25 protruding from the underside and oriented with their axes parallel to one another and to filling element axis FA. The number and arrangement of plungers 25 is the same as the number and arrangement of channel sections 24 in insert 23, so each channel section 24 is assigned a plunger 25. The outside diameter of plungers 25 is again slightly less than the inside diameter of the associated channel section 24.

The underside of valve body 9*c* is also provided with a plate-like seal 26 through which pass plungers 25]. When filling element 1*c* is open, valve body 9*c*, controlled by the actuating device (not shown), is in its raised stroke position in which the underside of valve body 9*c* and the bottom ends of plungers 25 are at a distance from the top of insert 23 and from the top ends of channel sections 24, so that when filling element 1*c* is open, as shown in FIG. 11, there can be an unhindered flow of the liquid filling material through liquid channel 5*c* and channel sections 24 to generate filling jet 3.

When filling element 1*c* is closed, as shown in FIG. 12, valve body 9*c* lies sealed by seal 26 against the top of insert 23 so that liquid channel 5*c* is closed in the region of liquid valve 8*c*. Each plunger 25 is received in a channel section 24.

In this embodiment too, liquid valve 8*c* is already at least mostly closed when plungers 25 enter their respective channel sections 24, and before seal 26 comes to rest against the top of insert 23, which forms the valve face. With this embodiment too, the introduction of plungers 25 into channel sections 24 not only achieves a clear centering of valve body 9*c* when liquid valve 8*c* is closed, but plungers 25, as they enter channel sections 24, also displace at least part of the volume of the liquid filling material from channel sections 24, thereby among other things removing any solid or relatively solid filling material constituents that may have deposited in channel sections 24 by flushing them out together with the displaced volume of filling material.

The closing of channel sections 24 at the top of insert 23 also forms a kind of gas barrier that prevents dripping and that guarantees that any remains of filling material left in channel sections 24 are retained there and do not lead to dripping from closed filling element 1*c* even if insert 23 as such is not active as a gas barrier.

The invention has been described hereinbefore by reference to embodiments. It goes without saying that numerous variations as well as modifications are possible without departing from the inventive concept underlying the invention.

For example, it has been assumed that channel sections 20 or 24 are each configured in an insert 19 or 23 respectively. It is of course also possible for these channel sections or corresponding channels to be configured directly on the respective filling element housing or housing part.

LIST OF REFERENCE CHARACTERS

1, 1*a*-1*c* Filling element
2 Container or bottle
2.1 Container opening or bottle opening
3 Filling jet
4, 4*a*, 4*b*, 4*c* Filling element housing
5, 5*a*-5*c* Liquid channel
5.1-5.5 Channel section
6 Product line or channel
7 Dispensing opening
8, 8*a*-8*c* Liquid valve
9,9*a* Valve body
10 Valve stem
11 Seal
12 Valve seat
13 Seal
14 Plunger
14' Plunger end
15 Bell-shaped body
16 Interior of bell-shaped body 15
17 Tube
18, Annular gap
19 Insert
20 Channel section
21 Plunger
22 Ring seal
23 Insert
24 Channel section
25 Plunger
26 Seal

The invention claimed is:

1. An apparatus for open jet filling of containers with a liquid filling material, said apparatus comprising a filling element, said filling element comprising a dispensing opening, a drip prevention structure, a filling element housing, a liquid channel, a liquid valve, a plunger, a ring seal, and a valve body, wherein said liquid valve is provided in said liquid channel for controlled dispensing of said liquid filling material into said container at said dispensing opening, wherein said liquid channel is configured in said filling element housing, wherein liquid filling material flows through said liquid channel during open jet filling of a container, wherein, during open-jet filling, said liquid channel extends along a flow direction having an upstream direction and a downstream direction, wherein said liquid channel comprises an upstream liquid channel portion and a downstream liquid channel portion, wherein said downstream liquid channel portion is that portion of said liquid channel that is adjacent to and immediately upstream from said dispensing opening, wherein said upstream liquid channel portion is upstream from said downstream liquid channel portion, wherein said plunger extends along an axial direction, wherein said plunger comprise an outer contour, wherein said outer contour of said plunger has a surface normal vector that is perpendicular to said axial direction along which said plunger extends, wherein said downstream liquid channel portion comprises an inner contour, wherein said inner contour of said downstream liquid channel portion has a surface normal vector that is perpendicular to said axial direction along which said plunger extends, wherein said ring seal is disposed on said inner contour of said downstream liquid channel portion, wherein said outer contour of said plunger and said inner contour of said downstream liquid channel portion define an annular gap, wherein said drip-prevention structure prevents said liquid filling material from dripping when said liquid valve is closed, wherein said drip-prevention structure is formed only upon closure of said filling element, wherein said plunger is disposed on said valve body, wherein said plunger is axially movable between an opening position and a closing position, wherein, when said plunger is in said opening position, said plunger is in said upstream portion of said liquid channel, wherein, when said plunger is in said closing position, said ring seal and said outer contour of said plunger engage each other, thereby closing off said annular gap and forming said drip prevention structure.

2. The apparatus of claim 1, further comprising a gas barrier between said liquid valve and said dispensing opening, wherein said gas barrier is part of said drip-prevention structure.

3. The apparatus of claim 1, further comprising a gas barrier that is formed when said plunger moves in a direction that reduces flow cross-section of said filling element.

4. The apparatus of claim 1, wherein said drip-prevention structure comprises a gas barrier formed when said plunger moved so as to reduce a flow cross-section of said filling element. to at least an annular gap formed between at least one of an outer contour of said valve body and said function element and an inner contour of said filling material path.

5. The apparatus of claim 1, wherein said drip-prevention structure comprises a gas barrier formed by introduction of said plunger into said downstream liquid channel section, wherein said plunger is moved with said valve body or provided on said valve body for movement into said downstream liquid channel section.

6. The apparatus of claim 1, wherein said drip-prevention structure comprises a gas barrier formed by introduction of a plurality of plungers each into an associated channel section.

7. The apparatus of claim 1, wherein said drip-prevention structure comprises a gas barrier formed by a channel section that forms a dispensing opening, said channel section being closed at an end that is away from said dispensing opening, and by at least one of said valve body and plungers provided thereon.

8. The apparatus of claim 1, wherein said drip-prevention structure comprises additional plungers provided on said valve body, and a gas barrier, wherein said gas barrier is formed by channel sections, wherein each channel section is adjacent to a corresponding dispensing opening, wherein each channel sections is closed at an end that is away from said dispensing opening that corresponds to said channel section.

9. The apparatus of claim 1, wherein said valve body is configured to move in a first close stroke and a second close stroke, wherein said second close stroke is executed more slowly than said first close stroke, wherein said first close stroke and said second close stroke close said liquid valve.

* * * * *